US008614408B2

(12) United States Patent
Kamii

(10) Patent No.: US 8,614,408 B2
(45) Date of Patent: Dec. 24, 2013

(54) HEATING COOKING APPLIANCE

(75) Inventor: Yasuhiko Kamii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 34 days.

(21) Appl. No.: 13/375,133

(22) PCT Filed: Jul. 1, 2010

(86) PCT No.: PCT/JP2010/061243
§ 371 (c)(1),
(2), (4) Date: Nov. 29, 2011

(87) PCT Pub. No.: WO2011/002054
PCT Pub. Date: Jan. 6, 2011

(65) Prior Publication Data

US 2012/0074124 A1 Mar. 29, 2012

(30) Foreign Application Priority Data

Jul. 3, 2009 (JP) ..... 2009-158533

(51) Int. Cl.
*A21B 1/00* (2006.01)
*F24C 15/32* (2006.01)

(52) U.S. Cl.
USPC ..... 219/400; 219/402; 219/407; 219/681; 219/685; 219/757; 126/21 A; 126/273 A; 126/275 E

(58) Field of Classification Search
USPC ..... 219/400, 402, 407, 681, 685, 757; 126/21 A, 273 A, 275 E
See application file for complete search history.

(56) References Cited

U.S. PATENT DOCUMENTS

| | | | | |
|---|---|---|---|---|
| 6,541,745 | B2 * | 4/2003 | Kim et al. | 219/681 |
| 2002/0056712 | A1 | 5/2002 | Kim et al. | |
| 2007/0107712 | A1 | 5/2007 | Shiraichi et al. | |

FOREIGN PATENT DOCUMENTS

| | | | |
|---|---|---|---|
| JP | 2002-162039 | A | 6/2002 |
| JP | 2004-361069 | A | 12/2004 |
| JP | 2009-2627 | A | 1/2009 |

* cited by examiner

*Primary Examiner* — Shawntina Fuqua
(74) *Attorney, Agent, or Firm* — Birch, Stewart, Kolasch & Birch, LLP

(57) ABSTRACT

A heating cooking appliance includes a heating chamber for items to be cooked, a circulation duct connecting an inlet port and an outlet port both of which open into the heating chamber, an air blower located in the circulation duct, and a heating device in the upper part of the heating chamber. Gas in the heating chamber is taken into the circulation duct from the inlet port by the blower. The gas temperature is raised by the heating device, and subsequently, the gas is blown into the heating chamber from the inlet port. The circulation duct is provided with first and second paths which branch off upstream of the heating device. The first and second paths guide gas to the area upstream and downstream of the heating device, respectively.

8 Claims, 7 Drawing Sheets

HEATING COOKING APPLIANCE

TECHNICAL FIELD

The present invention relates to a heating cooking appliance that circulates a gas in a heating chamber to perform heating cooking.

BACKGROUND ART

FIG. 7 is a side sectional view showing a conventional heating cooking appliance. A heating cooking appliance 1 includes a heating chamber 2 that houses an ingredient to be cooked which is placed through a front side when a door 3 is opened. An inlet port 2*a* opens through a rear side of the heating chamber 2, and an outlet port 2*b* opens through a ceiling side. The inlet port 2*a* and the outlet port 2*b* are connected to each other by a circulation duct 20 that is disposed around the heating chamber 2. An air blower 31 facing the inlet port 2*a* is disposed in a rear portion 21 of the circulation duct 20, and a heating device 32 is disposed in a ceiling portion 22 of the circulation duct 20.

Thanks to driving of the air blower 31, air in the heating chamber 2 flows into the circulation duct 20 from the inlet port 2*a* as indicted by an arrow A1. The air flowing into the circulation duct 20 is guided from the rear side to the ceiling portion 22 as indicated by an arrow A2 and raised in temperature by the heating device 32. The air raised in temperature by the heating device 32 is output from the outlet port 2*b* into the heating chamber 2 as indicated by an arrow A3. According to this, the air in the heating chamber 2 circulates via the circulation duct 20, and the ingredient is heated and cooked by the air output from the outlet port 2*b* into the heating chamber and radiant heat from the heating device 32.

CITATION LIST

Patent Literature

PLT1: JP-A-2009-2627 (page 3 to page 10, FIG. 2)

SUMMARY OF INVENTION

Technical Problem

However, according to the conventional heating cooking appliance 1, the air is supplied to the ceiling portion 22 of the circulation duct 20 from the rear side that is an upstream side with respect to the heating device 32. According to this, an upstream portion of the heating device 32 is easily cooled but a downstream portion of the heating device 32 is only slightly cooled, so that the downstream portion becomes higher than the upstream portion in surface temperature. Because of this, there is a problem that the surface temperature of the downstream portion of the heating device 32 is raised to a high temperature; and the life of the heating device 32 becomes short. Besides, electric power supplied to the heating device 32 is restricted by the surface temperature of the downstream portion, there is a problem that the cooking time becomes long. Here, the same problem occurs in a heating cooking appliance as well that performs cooking by supplying steam to the heating chamber 2 and maintaining the steam at a predetermined temperature by means of the heating device 32.

It is an object of the present invention to provide a heating cooking appliance that achieves a long life of the heating device and is able to shorten the cooking time.

Solution to Problem

To achieve the above object, a heating cooking appliance according to the present invention includes:

a heating chamber that houses an ingredient to be cooked;

a circulation duct that connects an inlet port and an outlet port, which are opened through a wall surface of the heating chamber, to each other;

an air blower that is disposed in the circulation duct; and a heating device that is disposed in the circulation duct over the heating chamber;

the heating cooking appliance introduces a gas in the heating chamber from the inlet port into the circulation duct thanks to driving of the air blower; and raises the gas in temperature by means of the heating device; wherein the circulation duct includes first and second paths that branch off at an upstream position with respect to the heating device;

the first path guides the gas to an upstream portion of the heating device; and the second path guides the gas to a downstream portion of the heating device to allow the gas to join the gas that flows in the first path.

According to this structure, when the air blower is driven, the gas including air and steam in the heating chamber flows into the circulation duct via the inlet port. The gas flowing into the circulation duct branches off into the first and second paths and is guided to the heating device disposed over the heating chamber. Here, the second path guides the gas to the downstream portion of the heating device, while the first path guides the gas to the upstream portion of the heating device to allow the gas to join the gas flowing in the second path at the downstream portion of the heating device. The gas flowing in the first and second paths is raised in temperature by the heating device and output from the outlet port into the heating chamber. According to this, the gas in the heating chamber circulates via the circulation duct and the ingredient is cooked by the gas raised in temperature by the heating device and radiant heat from the heating device.

Besides, in the heating cooking appliance having the above structure according to the present invention, the second path is disposed over the first path via a partition plate. According to this structure, the gas flowing in the circulation duct is branched vertically by the partition plate and joins at the downstream portion of the heating device.

Besides, in the heating cooking appliance having the above structure according to the present invention, the partition plate is provided with a small hole that faces a predetermined position of an upstream portion of the first path. According to this structure, part of the gas flowing in the second path flows into the first path via the small hole.

Besides, in the heating cooking appliance having the above structure according to the present invention, the small hole is formed right over or substantially right over the heating device.

Besides, the heating cooking appliance having the above structure according to the present invention is provided with a guide plate that blocks a flow path for the gas flowing in the second path and guides the gas to the small hole.

Besides, a heating cooking appliance according to the present invention includes:

a heating chamber that houses an ingredient to be cooked;

a circulation duct that connects an inlet port and an outlet port, which are opened through a wall surface of the heating chamber, to each other;

an air blower that is disposed in the circulation duct; and a heating device that is disposed in the circulation duct over the heating chamber;

the heating cooking appliance introduces a gas in the heating chamber from the inlet port into the circulation duct thanks to driving of the air blower; raises the gas in temperature by means of the heating device; and outputs the gas from the outlet port into the heating chamber; wherein the circulation duct includes first and second paths that branch off at an upstream position with respect to the heating device and separated from each other by a partition plate;

the heating device is disposed in the first path; and the partition plate is provided with a small hole that faces a predetermined position of the first path.

According to this structure, when the air blower is driven, the gas including the air and steam in the heating chamber flows into the circulation duct via the inlet port. The gas flowing into the circulation duct is branched off into the first and second paths by the partition plate; and the gas flowing in the first path is raised in temperature by the heating device disposed in the first path. Besides, the gas flowing in the second path is supplied to a predetermined position of the first path via the small hole, and raised in temperature by the heating device. The gas raised in temperature by the heating device is output from the outlet port into the heating chamber. According to this, the gas in the heating chamber circulates via the circulation duct, and the ingredient is heated and cooked by the gas raised in temperature by the heating device and the radiant heat from the heating device.

Besides, in the heating cooking appliance having the above structure according to the present invention, the small hole is formed right over or substantially right over the heating device.

Besides, the heating cooking appliance having the above structure according to the present invention is provided with a guide plate that blocks a flow path for the gas flowing in the second path and guides the gas to the small hole.

Advantageous Effects of Invention

According to the present invention, the circulation duct branches off into: the first path that guides the gas to the upstream portion of the heating deice; and the second path that guides the gas to the downstream portion of the heating device and joins the first path, so that it is possible to evenly cool the heating device from the upstream portion to the downstream portion. Accordingly, the surface temperature of the heating device is maintainable at a low temperature, so that it is possible to achieve a long life of the heating device. Besides, it is possible to increase electric power supplied to the heating device and shorten the cooking time.

Besides, according to the present invention, the circulation duct braches off into: the first path that is provided with the heating device; and the second path that is provided with the small hole which faces the first path, so that the gas is suppliable from the second path via the small hole to a portion of the first path which is locally raised to a high temperature by the heating device. According to this, it is possible to evenly cool the heating device from the upstream portion to the downstream portion. Accordingly, the surface temperature of the heating device is maintainable at a low temperature, so that it is possible to achieve a long life of the heating device. Besides, it is possible to increase electric power supplied to the heating device and shorten the cooking time.

DESCRIPTION OF EMBODIMENTS

Figure 1:
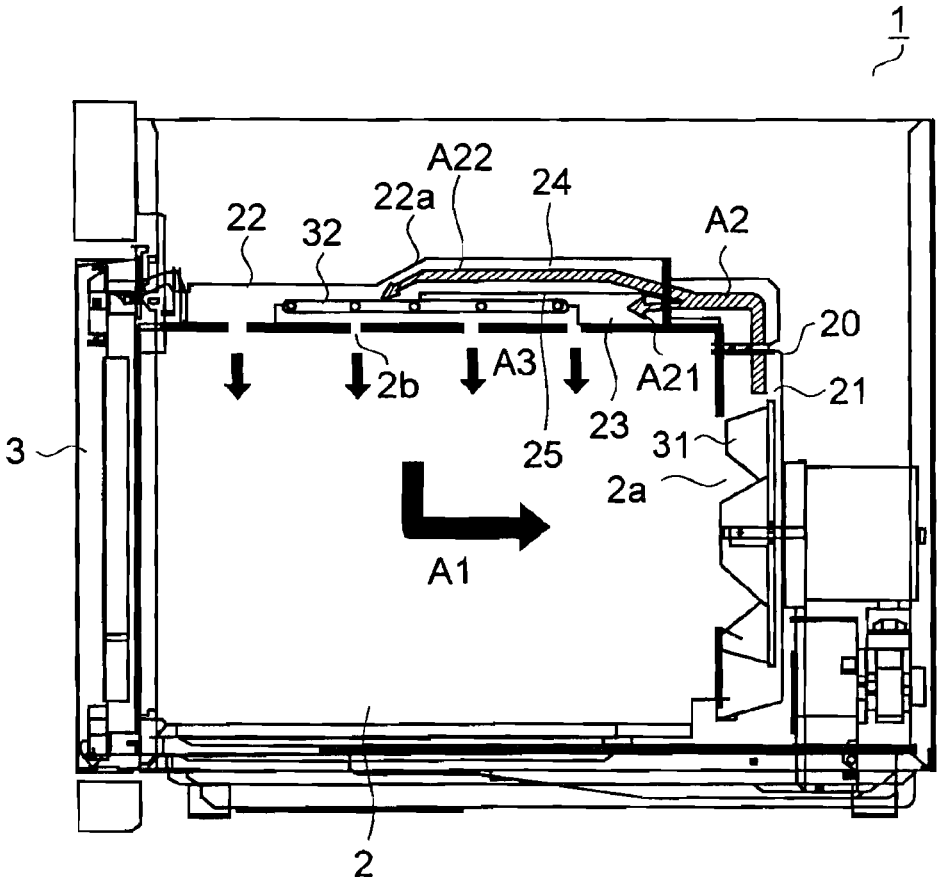
FIG. 1 is a side sectional view showing a heating cooking appliance according to a first embodiment of the present invention.
Figure 7:
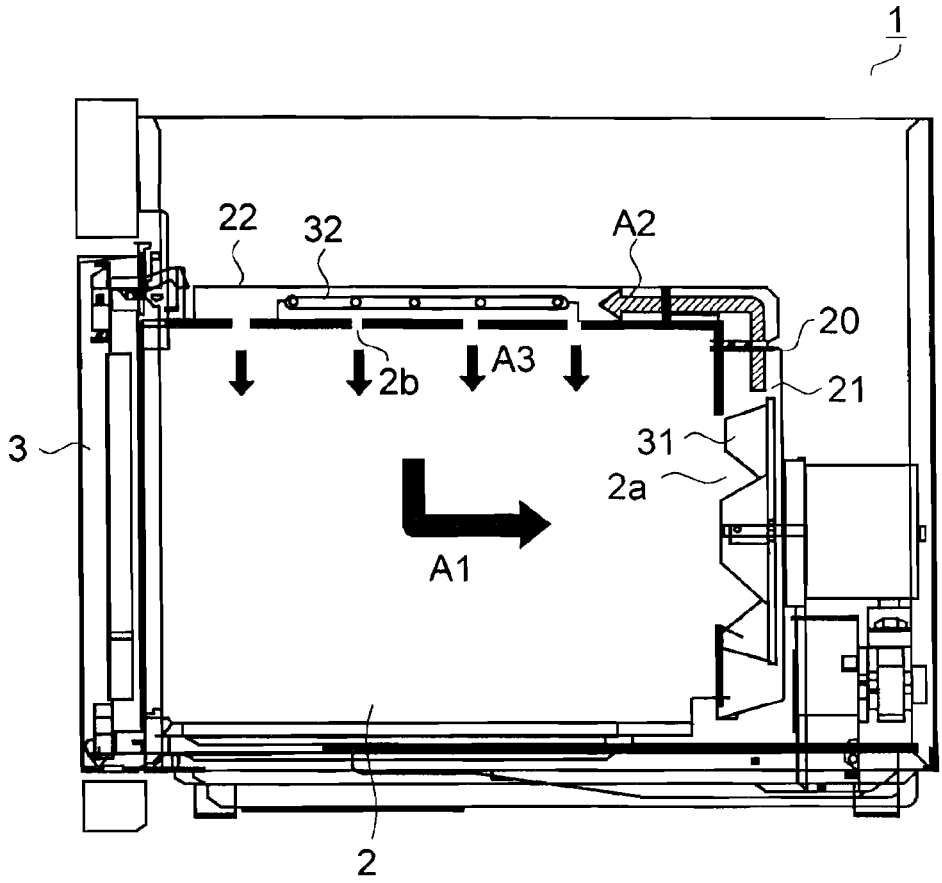
FIG. 7 is a side sectional showing a conventional heating cooking appliance.

Hereinafter, embodiments of the present invention are described with reference to the drawings. For the sake of description, the same portions as those in the conventional example shown in FIG. 7 are indicated by the same reference numbers. FIG. 1 is a side sectional view showing a heating cooking appliance according to a first embodiment. The heating cooking appliance 1 includes the heating chamber 2 that houses an ingredient to be cooked which is placed through the front side when the door 3 is opened.

The inlet port 2*a* is opened through the rear side of the heating chamber 2, and the outlet port 2*b* is opened through the ceiling surface of the heating chamber 2. The inlet port 2*a* and the outlet port 2*b* are connected to each other by the circulation duct 20 that is disposed around the heating chamber 2. The air blower 31 facing the inlet port 2*a* is disposed in the rear portion 21 of the circulation duct 20. The ceiling portion 22 of the circulation duct 20 is divided by a partition plate 25 into a lower first path 23 and an upper second path 24. The heating device 32 is disposed in the first path 23.

Figure 2:
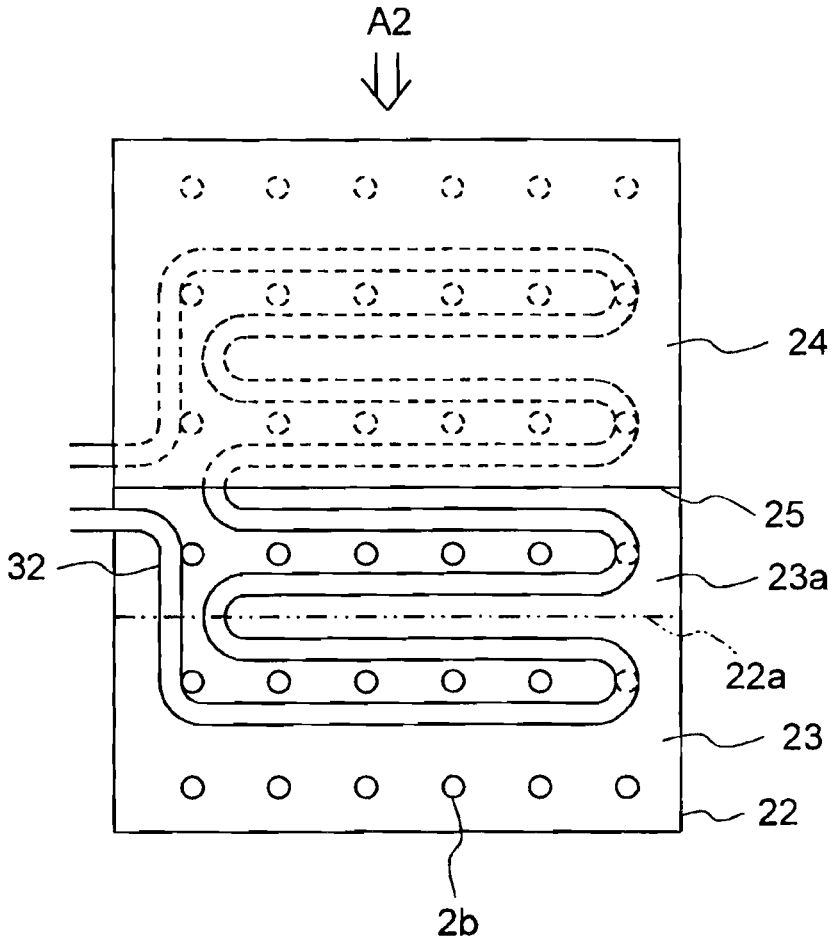
FIG. 2 is a plan view showing a ceiling portion of a circulation duct of the heating cooking appliance according to the first embodiment of the present invention.

FIG. 2 shows a plan view of the ceiling portion 22 of the circulation duct 20. In the figure, an upper portion is a rear side of the heating cooking appliance 1. The heating device 32 is formed of a tube-like sheathed heater that is supplied with electricity from a side and snakes its way. The partition plate 25 is formed of stainless steel or the like, covers an upstream portion of the heating device 32 and separates the first and second paths from each other. A downstream portion of the heating device 32 is covered by an upper plate 22*a* of the ceiling portion 22, and an opening portion 23*a* is formed in a horizontal direction between the upper plate 22*a* and the partition plate 25. The first path 23 and the second path 24 join each other via the opening portion 23*a*.

Thanks to driving of the air blower 31, air in the heating chamber 2 flows into the circulation duct 20 from the inlet port 2*a* as indicted by the arrow A1. The air flowing into the circulation duct 20 is guided from the rear side to the ceiling portion 22 as indicated by the arrow A2 and branched by the partition plate 25 into the first and second paths 23, 24. As indicated by an arrow A21, the air flowing in the first path 23 travels from the upstream portion of the heating device 32 to the downstream portion of the heating device 32. The air flowing in the second path 24, as indicated by an arrow A22, joins the first path 23 via the opening portion 23*a* and is guided to the downstream portion of the heating device 32.

The air raised in temperature by contact with the heating device 32 is output from the outlet port 2*b* into the heating chamber 2 as indicated by the arrow A3. According to this, the air in the heating chamber 2 circulates via the circulation duct 20, and the ingredient is heated and cooked by the air, which is output from the outlet port 2*b* into the heating chamber 2, and the radiant heat from the heating device 32.

According to the present embodiment, the ceiling portion 22 of the circulation duct 20 branches off into: the first path 23 that guides the air to the upstream portion of the heating deice 32; and the second path 24 that guides a gas to the downstream portion of the heating device 32 and joins the first path 23, so that it is possible to evenly cool the heating device 32 from the upstream portion to the downstream portion. Accordingly, the surface temperature of the heating device 32 is maintainable at a low temperature, so that it is possible to achieve a long life of the heating device 32. Besides, it is possible to increase electric power supplied to the heating device 32 and shorten the cooking time.

Besides, the second path 24 is disposed over the first path 23 via the partition plate 25, so that it is possible to easily branch the circulation duct 20. Besides, it is possible to secure a larger flow-path area of the second path 24 than disposing the first and second paths 23, 24 in a front-rear direction, so that it is possible to surely cool the downstream portion of the heating device 32.

Figure 3:
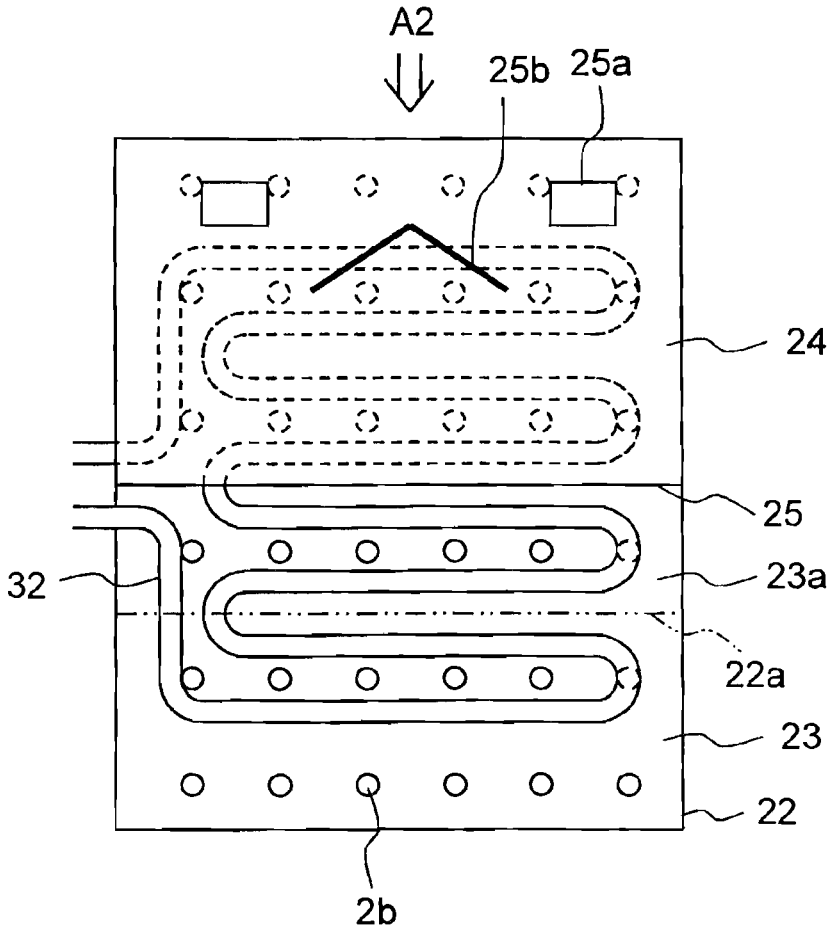
FIG. 3 is a plan view showing a partition plate of the heating cooking appliance according to the first embodiment of the present invention.

Here, as shown in FIG. 3, the partition plate 25 may be provided with a small hole 25*a* that has an opening area smaller than the opening portion 23*a* and faces a predetermined position of the upstream portion of the first path 23. The small hole 25*a*, as shown in the figure, is disposed, for example, at both end portions on the flow-in side of the second path 24. Part of the air flowing in the second path 24 flows into the first path 23 via the small hole 25*a*. According to this, it is possible to supply air from the second path 24 via the small hole 25 to a portion into which the air in the first path 23 only slightly spreads and to more evenly cool the upstream portion of the heating device 32.

Besides, as shown in the figure, if the partition plate 25 is provided with a guide plate 25*b* that guides the air to the small hole 25, it is possible to surely supply the air from the small hole 23 to the first path 23, which is more desirable. Here, the small hole 25*a* may be disposed right over or substantially right over the tube-like heating device 32 that snakes. According to this, the air, which is supplied from the small hole 25*a*, is able to directly touches the heating device 32, whose surface temperature rises, to cool the heating device 32.

Figure 4:
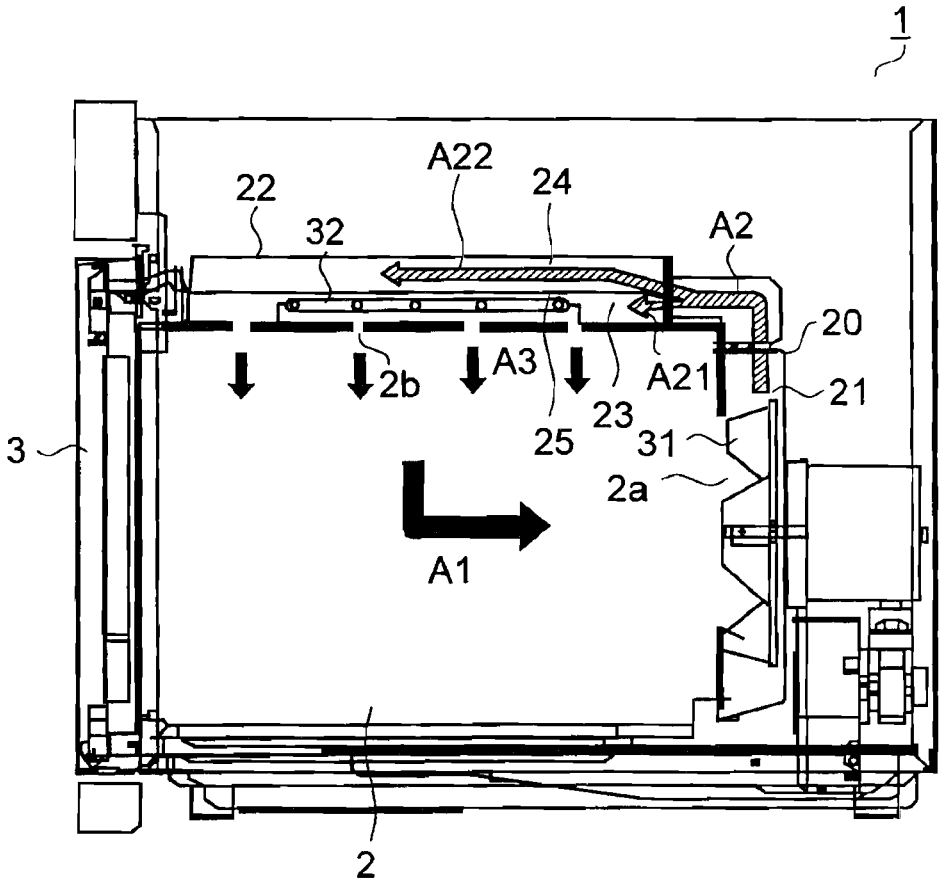
FIG. 4 is a side sectional view showing a heating cooking appliance according to a second embodiment of the present invention.

Next, FIG. 4 shows a side sectional view of a heating cooking appliance according to a second embodiment. For the sake of description, the same portions as those shown in FIG. 1 to FIG. 3 described above are indicated by the same reference numbers. The present embodiment is different from the first embodiment in structure of the partition plate 25 of the ceiling portion 22 of the circulation duct 20. The other portions are the same as the first embodiment.

Figure 5:
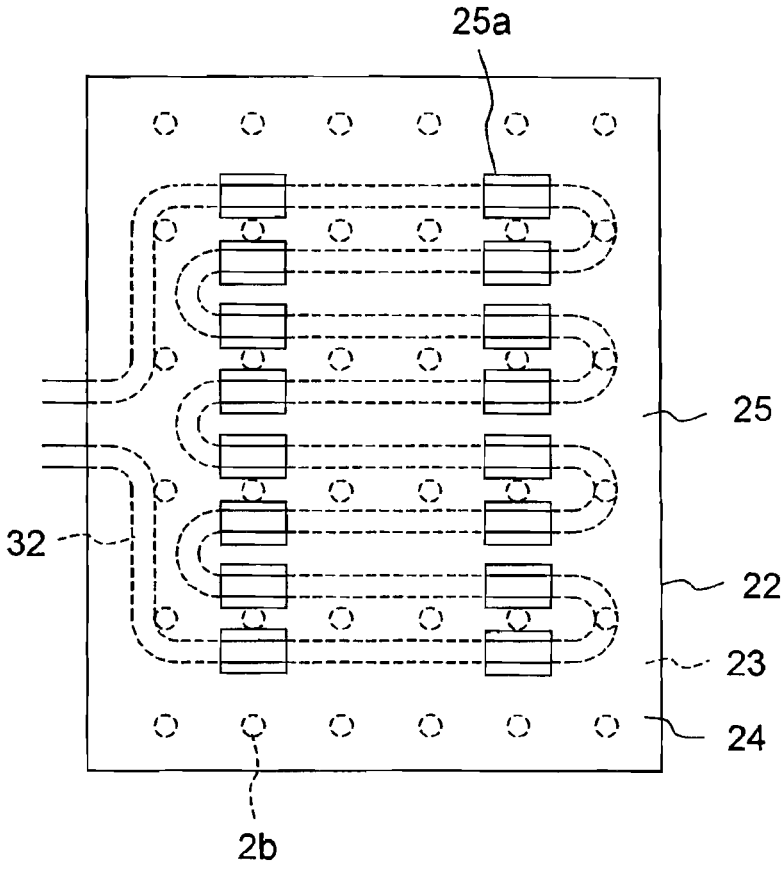
FIG. 5 is a plan view showing a ceiling portion of a circulation duct of the heating cooking appliance according to the second embodiment of the present invention.

The entire ceiling portion 22 of the circulation duct 20 is separated by the partition plate 25 into the first and second paths 23, 24. FIG. 5 shows a plan view of the ceiling portion 22 of the circulation duct 20. The partition plate 25 covers the entire surface of the first path 23 and is provided with a plurality of the small holes 25*a* that face the first path 23. The small hole 25*a* is disposed right over or substantially right over the tube-like heating device 32.

Thanks to driving of the air blower 31, the air, which flows from the heating chamber 2 into the circulation duct 20 via the inlet port 2*a* as indicted by the arrow A1, is guided from the rear side to the ceiling portion 22 as indicated by the arrow A2. Thanks to the partition plate 25, as indicated by the arrow A21, the air flowing in the first path 23 travels from the upstream portion of the heating device 32 to the downstream portion of the heating device 32. The air flowing in the second path 24, as indicated by the arrow A22, flows into the first path 23 via the small hole 25*a*. Here, the air, which is supplied from the small hole 25*a*, is able to directly touches the heating device 32, whose surface temperature rises, to cool the heating device 32.

The air raised in temperature by the contact with the heating device 32 is output from the outlet port 2*b* into the heating chamber 2 as indicated by the arrow A3. According to this, the air in the heating chamber 2 circulates via the circulation duct 20, and the ingredient is heated and cooked by the air, which is output from the outlet port 2*b* into the heating chamber 2, and the radiant heat from the heating device 32.

According to the present embodiment, the ceiling portion 22 of the circulation duct 20 braches off into: the first path that is provided with the heating device 32; and the second path 24 that is provided with the small hole 25*a* which faces the first path 23, so that the air is suppliable from the second path 24 via the small hole 25 to a portion of the first path 23 which is locally raised to a high temperature by the heating device 32. According to this, it is possible to evenly cool the heating device 32 from the upstream portion to the downstream portion. Accordingly, the surface temperature of the heating device 32 is maintainable at a low temperature, so that it is possible to achieve a long life of the heating device 32. Besides, it is possible to increase electric power supplied to the heating device 32 and shorten the cooking time.

Here, the small hole 25*a* may be disposed at another portion of the first path 23 which is raised to a high temperature. Here, as shown in FIG. 3 described above, the guide plate 25*b* for guiding the air to the small hole 25 may be disposed.

Figure 6:
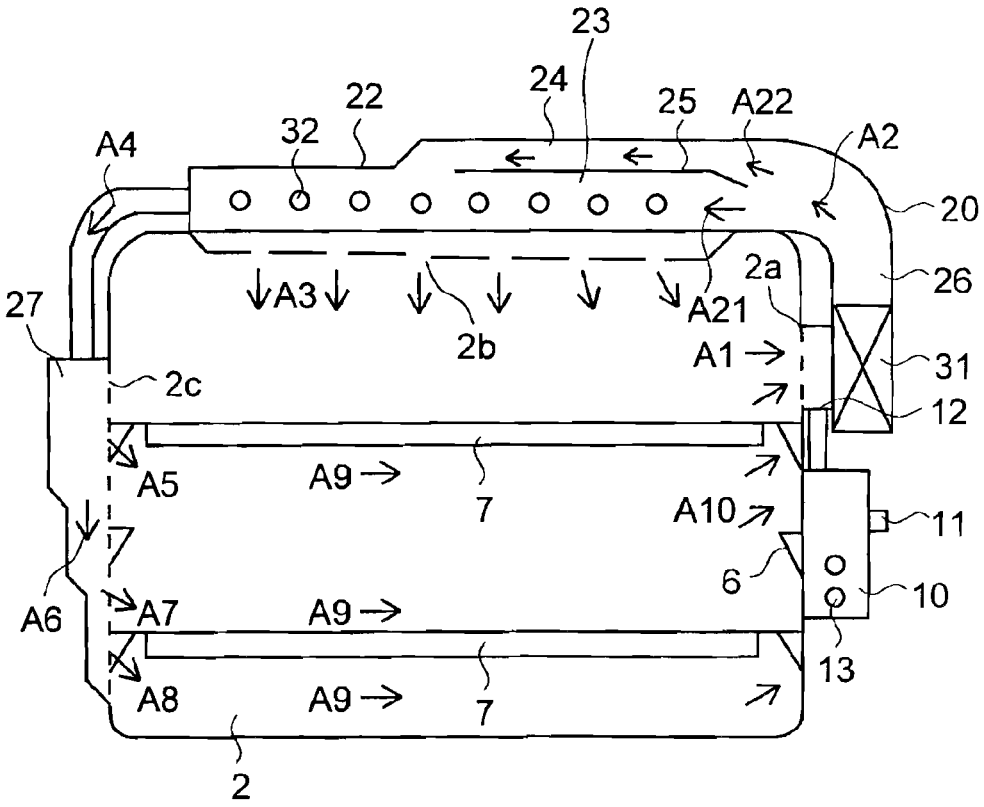
FIG. 6 is a front sectional view showing a heating cooking appliance according to a third embodiment of the present invention.

Next, FIG. 6 shows a front sectional view of a heating cooking appliance according to a third embodiment. For the sake of description, the same portions as those shown in FIG. 1 to FIG. 3 described above are indicated by the same reference numbers. The present embodiment is different from the first embodiment in that the cooking is performed by supplying steam to the heating chamber 2 and different in disposition of the circulation duct 20. The other portions are the same as the first embodiment.

A plurality of disposition portions 6 are disposed in a vertical direction on both side surfaces of the heating chamber 2; and a placement tray 7, on which an ingredient is placed, is disposed on the disposition portion 6. According to this, it is possible to perform the cooking with the placement trays 7 disposed vertically on a plurality of stages. Here, an opening portion (not shown), via which an air flow is able to pass, is formed through a grasp portion around the placement tray 7.

The inlet port 2*a* is opened through an upper portion of the right side surface of the heating chamber 2, while the outlet ports 2*b*, 2*c* are opened through the ceiling surface and the left side surface of the heating chamber 2, respectively. The inlet port 2*a* is disposed above the upper-stage disposition portion 6. The outlet port 2*b* is formed of a plurality of small holes. The outlet port 2*c* at the side surface widely opens from a portion above the upper-stage disposition portion 6 to a portion below the lower-stage disposition portion 6. The outlet port 2*c* may be divided vertically and disposed.

The inlet port 2*a* and the outlet port 2*c* are connected to each other by the circulation duct 20. The air blower 31 facing the inlet port 2*a* is disposed in a right side portion 26 of the circulation duct 20. The ceiling portion 22 of the circulation duct 20 is structured in the same way as in the first embodiment, and is divided by the partition plate 25 into the lower first path 23 and the upper second path 24. The heating device 32 is disposed in the first path 23. The inlet port 2*c* is opened through a left side portion 27 of the circulation duct 20.

A steam supply portion 10 is disposed at a lower portion of the right side surface of the heating chamber 2. In the steam supply portion 10, a steam generation heater 13 formed of a sheathed heater is buried in a metal container that has a water supply port 11 and an output port 12. The water supply port 11 is supplied with water for steam generation from a releasable water supply tank (not shown). The steam generation heater 13 vaporizes the water supplied from the water supply port 11 to generate steam. The output port 12 is opened through the right side portion 26 of the circulation duct 20; and outputs the steam generated by the steam supply portion 10 into the circulation duct 20.

The heating device 32 is structured in the same way as in the first embodiment, and heats the steam flowing in the ceiling portion 22 of the circulation duct 20. According to this, it is possible to maintain the steam at a predetermined temperature and perform the cooking by means of saturated steam and superheated steam.

In the heating cooking appliance 1 having the above structure, when an ingredient to be cooked is placed on the placement tray 7 and the cooking is started, water is supplied from the water supply tank (not shown) to the steam generation portion 10 via the water supply port 11. The water supplied to the steam generation portion 10 is vaporized by the steam generation heater 13, whereby steam is generated. The steam flowing from the output port 10 into the circulation duct 20 is supplied from the outlet port 2*b* into the heating chamber 2 thanks to the driving of the air blower 31.

Besides, thanks to the driving of the air blower 31, the steam in the heating chamber 2 flows into the circulation duct 20 from the inlet port 2*a* as indicted by the arrow A1. The steam flowing into the circulation duct 20 is guided from the side to the ceiling portion 22 as indicated by the arrow A2 and branched by the partition plate 25 into the first and second paths 23, 24. As indicated by the arrow A21, the steam flowing in the first path 23 travels from the upstream portion of the heating device 32 to the downstream portion of the heating device 32. The steam flowing in the second path 24, as indicated by the arrow A22, joins the first path 23 via the opening portion 23*a* (see FIG. 2) and is guided to the downstream portion of the heating device 32.

The steam raised in temperature by the contact with the heating device 32 is output from the outlet port 2*b* into the heating chamber 2 as indicated by the arrow A3. Besides, part of the steam raised in temperature by the heating device 32 flows from the ceiling portion 22 into the left side portion 27 as indicated by an arrow A4. The steam flowing into the left side portion 27 is output from the outlet port 2*c* into the heating chamber 2 as indicated by arrows A5, A7 and A8. The steam output from the outlet port 2*c* flows in the heating chamber 2 in a lateral direction as indicted by an arrow A9 and flows into the circulation duct 20 via the inlet port 2*a* as indicated by an arrow A10.

According to this, the steam in the heating chamber 2 circulates via the circulation duct 20, and the ingredient is heated and cooked by the steam raised in temperature by the heating device 32 and the radiant heat from the heating device 32. Here, the cooking may be performed by means of the saturated steam by maintaining the steam at a temperature near 100° or may be performed by means of the superheated steam by maintaining the steam at a temperature of 100° or higher (e.g., 300°).

According to the present embodiment, like in the first embodiment, the ceiling portion 22 of the circulation duct 20 braches off into: the first path 23 that guides the air to the upstream portion of the heating device 32; and the second path 24 that guides the gas to the downstream portion of the heating device 32 and joins the first path 23, so that it is possible to evenly cool the heating device 32 from the upstream portion to the downstream portion. Accordingly, the surface temperature of the heating device 32 is maintainable at a low temperature, so that it is possible to achieve a long life of the heating device 32. Besides, it is possible to increase electric power supplied to the heating device 32 and shorten the cooking time.

In the present embodiment, like in the first and second embodiments, the cooking may be performed with hot air obtained by raising the air in temperature by means of the heating device 32; and the inlet port 2*a* may be formed through the rear surface of the heating chamber 2. Besides, the partition plate 25 may be structured in the same way as in FIG. 3 and FIG. 5 described above.

Industrial Applicability

The present invention is applicable to a heating cooking appliance that circulates a gas in a heating chamber to perform heating cooking.

Reference Signs List

1 heating cooking appliance
2 heating chamber
2*a* inlet port
2*b*, 2*c* outlet port
3 door
6 disposition portion
7 placement tray
10 steam supply portion
11 water supply port
12 output port
13 steam generation heater
20 circulation duct
21 rear portion
22 ceiling portion
23 first path
24 second path
25 partition plate
25*a* small hole
25*b* guide portion
26 right side portion
27 left side portion
31 air blower
32 heating device

The invention claimed is:

1. A heating cooking appliance comprising:

a heating chamber that houses an ingredient to be cooked;

a circulation duct that connects an inlet port and an outlet port, which are opened through a wall surface of the heating chamber, to each other;

an air blower that is disposed in the circulation duct; and a heating device that is disposed in the circulation duct over the heating chamber;

the heating cooking appliance introduces a gas in the heating chamber from the inlet port into the circulation duct thanks to driving of the air blower; and raises the gas in temperature by means of the heating device; wherein the circulation duct includes first and second paths that branch off by means of a partition plate at an upstream position with respect to the heating device;

the first path guides the gas to an upstream portion of the heating device; and the second path connects with the first path at a downstream end portion of the partition plate, guides all the gas flowing in the second path to a downstream portion of the heating device to allow the gas to join the gas that flows in the first path, and sends the joining gas to the heating chamber.

2. The heating cooking appliance according to claim 1, wherein the second path is disposed over the first path via a partition plate.

3. The heating cooking appliance according to claim 2, wherein the partition plate is provided with a small hole that faces a predetermined position of an upstream portion of the first path.

4. The heating cooking appliance according to claim 3, wherein the small hole is formed right over or substantially right over the heating device.

5. The heating cooking appliance according to claim 4, further comprising a guide plate that blocks a flow path for the gas flowing in the second path and guides the gas to the small hole.

6. A heating cooking appliance comprising:

a heating chamber that houses an ingredient to be cooked;

a circulation duct that connects an inlet port and an outlet port, which are opened through a wall surface of the heating chamber, to each other;

an air blower that is disposed in the circulation duct; and a heating device that is disposed in the circulation duct over the heating chamber;

the heating cooking appliance introduces a gas in the heating chamber from the inlet port into the circulation duct thanks to driving of the air blower; raises the gas in temperature by means of the heating device; and outputs the gas from the outlet port into the heating chamber; wherein the circulation duct includes first and second paths that branch off at an upstream position with respect to the heating device and separated from each other by a partition plate;

the heating device is disposed in the first path; and the partition plate is provided with a small hole that faces a predetermined position of the first path; and all the gas flowing in the second path joins the gas flowing in the first path via the small hole and is sent to the heating chamber.

7. The heating cooking appliance according to claim 6, wherein the small hole is formed right over or substantially right over the heating device.

8. The heating cooking appliance according to claim 7, further comprising a guide plate that blocks a flow path for the gas that flows in the second path and guides the gas to the small hole.

* * * * *